US005885092A

United States Patent [19]

Ito et al.

[11] Patent Number: 5,885,092

[45] Date of Patent: Mar. 23, 1999

[54] ELECTRIC CONNECTOR ASSEMBLY WITH IMPROVED REGISTRATION CHARACTERISTICS

[75] Inventors: Tomoaki Ito, Machida; Shinichi Aihara, Ebina, both of Japan

[73] Assignee: Molex Incorporated, Lisle, Ill.

[21] Appl. No.: 880,126

[22] Filed: Jun. 20, 1997

Related U.S. Application Data

[63] Continuation-in-part of Ser. No. 816,225, Mar. 12, 1997.

[30] Foreign Application Priority Data

Jun. 21, 1996 [JP] Japan ..... 8-181157

[51] Int. Cl.[6] ..... H01R 9/09

[52] U.S. Cl. ..... 439/74

[58] Field of Search ..... 439/74, 81, 83, 439/733.1, 60, 637, 660, 292, 293, 284, 346

[56] References Cited

U.S. PATENT DOCUMENTS

| | | | |
|---|---|---|---|
| 3,364,458 | 1/1968 | Black, Jr. et al. | 439/680 |
| 4,490,000 | 12/1984 | Asick et al. | 439/75 |
| 4,682,829 | 7/1987 | Kunkle et al. | 439/83 |
| 4,734,060 | 3/1988 | Kawawada et al. | 439/660 |
| 4,929,185 | 5/1990 | Wong et al. | 439/74 |
| 5,057,028 | 10/1991 | Lemke et al. | 439/101 |
| 5,112,235 | 5/1992 | Enomoto et al. | 439/83 |
| 5,116,247 | 5/1992 | Enomoto et al. | 439/660 |
| 5,167,528 | 12/1992 | Nishiyama | 439/489 |
| 5,174,764 | 12/1992 | Kandybowski et al. | 439/83 |
| 5,176,541 | 1/1993 | Mori | 439/736 |
| 5,181,855 | 1/1993 | Mosquera et al. | 439/74 |
| 5,192,232 | 3/1993 | Lenz et al. | 439/660 |
| 5,199,884 | 4/1993 | Kaufman | 439/74 |
| 5,199,885 | 4/1993 | Korsunsky et al. | 439/79 |
| 5,224,866 | 7/1993 | Nakamura et al. | 439/81 |
| 5,277,597 | 1/1994 | Masami et al. | 439/83 |
| 5,310,357 | 5/1994 | Olson | 439/346 |
| 5,360,353 | 11/1994 | Kinoshita | 439/620 |
| 5,382,168 | 1/1995 | Azuma et al. | 439/65 |
| 5,395,250 | 3/1995 | Englert, Jr. et al. | 439/65 |
| 5,498,167 | 3/1996 | Seto et al. | 439/74 |

FOREIGN PATENT DOCUMENTS

| | | |
|---|---|---|
| 7-16381 | 3/1995 | Japan . |
| WO 97/04505 | 7/1996 | WIPO . |

*Primary Examiner*—Neil Abrams
*Assistant Examiner*—Barry M. L. Standig
*Attorney, Agent, or Firm*—James C. Paschall

[57] ABSTRACT

A connector assembly facilitates the registration of connector components. A plug connector in the assembly has a housing with a top surface defining a mating channel configured in a closed loop. A receptacle connector in the assembly has side walls of the housing configured in a closed loop which are received in the mating channel of the plug connector during mating. Terminals in the plug connector have contact portions disposed along the mating channel which engage respective contact portions of terminals disposed along the side walls of the receptacle connector upon mating.

16 Claims, 5 Drawing Sheets

ELECTRIC CONNECTOR ASSEMBLY WITH IMPROVED REGISTRATION CHARACTERISTICS

REFERENCE TO RELATED APPLICATION

This is a continuation-in-part of copending application Ser. No. 08/816,225 filed on Mar. 12, 1997.

BACKGROUND OF THE INVENTION

The present invention relates generally to electrical connectors of reduced size, and more particularly to surface mount miniature connector assemblies with improved means for registering and holding the components of the connector assembly together.

The trend of the electronics industry is to constantly reduce the size of electronic devices. Many electronic devices rely upon circuitry formed upon various printed circuit boards. These printed circuit boards must be joined together with connectors in a manner to effectively and reliably interconnect the circuits on one circuit board to the circuits on another circuit board.

In order to permit the connection of two circuit boards in parallel planes and to reduce the size of electronic devices, the connector industry developed the surface mount connector. A typical surface mount connector utilizes a plug-type male connector component that unites with an opposing receptacle-type, or female connector component. Both connector components are of low profile, allowing the circuit boards to be closely spaced to each other. When the connector components are engaged together, the mating terminals of the connector components form an electrical connection between the circuits of the two circuit boards.

It is desirable to retain the connector components in engagement with each other, and to fulfill this need, locking mechanisms have been developed for such connectors. The use of locking mechanisms that are separate from the connector components may lead to more complex structure and larger sizes of connectors. When the locking mechanisms are formed as part of the connector component housings, they waste space that could be used on the connector and because the mechanisms are made entirely from plastic.

In some connection applications the size of the connector portions themselves are extremely small, in what is known As the "micro-miniature" range, properly registering such small connectors to effect mating can be very difficult.

Holding small connectors together is also difficult. The approach in the industry with small connectors is to utilize frictional force to hold the connectors together. However, such frictional forces will not always reliably resist accidental unmating. Additionally, insertion forces cannot be so excessive as to cause difficultly in mating such connectors. Accordingly, the need exists for an easily registerable board to board connector that has a high degree of mechanical integrity and requires a sufficiently strong withdrawal force and a sufficiently light insertion force.

The present invention is therefore directed to an electric connector assembly which overcomes the aforementioned disadvantages and facilitates registering the associated connector components together for mating no matter how small the connector size.

SUMMARY OF THE INVENTION

To attain this and other objects, an electric connector assembly constructed in accordance with the principles of the present invention and as exemplified by a preferred embodiment thereof comprises a pair of connector components, each of the components having an insulative housing and a plurality of terminals fixed to the housing and arranged at regular intervals therein. The connector assembly has a first locking, or retention mechanism, in that the terminals of one of the connector components have locking portions formed thereon that are adapted to engage one or more catches formed on the other connector housing in position so that the terminals of one connector component engage the catches of the other connector component when the two connector components are mated together with their terminals engaged with each other, thereby fastening and retaining the connector components together.

The first connector component, a plug connector, has terminals that are stamped and formed from conductive metal blanks to define on each terminal, a body portion and a contact portion, a locking portion and a solder tail portion all extending from the body portion. The contact and locking portions of the terminal are spaced apart from each other to define a space or nest therebetween that receives a portion of the other connector component housing therein. In this arrangement, the locking and contact portions oppose each other. The locking portions may be formed coincidentally with the engagement portions in a vertical fashion on the same post which further reduces the horizontal or width dimensions of the connector assembly. The plug connector comprises two pairs of opposed side walls which surround a pedestal. The outer edge of the pedestal and the inner edges of the side walls define a closed-loop channel in communication with contact portions of the terminals protected by the top surface of the pedestal and the locking portions.

The second connector component, a receptacle connector, comprises two opposed pairs of side walls which are received within the closed-loop channel of the plug connector during mating. An array of recessed catches are located on outer surfaces of opposing side walls. The engageable locking portions of the plug connector and the catches of the receptacle connector are generally arranged in alignment with a widthwise axis of the connector assembly.

The opposed side walls and the pedestal portion of the plug connector all have the same height and have coplanar top surfaces. During mating, the top edges of the side walls and end walls of the receptacle connector slide across the coplanar top surface of the plug connector until the top edges of the receptacle connector all register with corresponding segments of the closed-loop channel of the plug connector. Upon registration, the plug connector and the receptacle connector are permitted to move closer together, which is physically detectable. Continuing the movement of the plug and receptacle connectors closer together will terminate with the connectors fully engaged, the corresponding contact portions of the terminals of each connector in electrical contact with each other and locking portions of the terminals in the plug connector in engagement with catches in the receptacle connector. The coplanar top surfaces of the plug connector facilitates registration and mating of miniature connectors for which registration and mating would be otherwise difficult.

In the preferred embodiment, the closed-loop channel has radiused corners defined between adjacent side walls of the plug connector. The corners of adjacent side walls of the receptacle connector are correspondingly radiused to facilitate registration and mating with the closed-looped channel of the plug connector.

It will be seen that the present invention reliably facilitates registration and mating the connectors of the invention.

The invention provides an easily registerable board-to-board connector assembly, or at least one connector used in such an assembly that exhibits a two-component insertion force and additional withdrawal force.

BRIEF DESCRIPTION OF THE DRAWINGS

In the course of the following detailed description reference will be frequently made to the accompanying drawings in which.

DESCRIPTION OF THE PREFERRED EMBODIMENT

Figure 1:
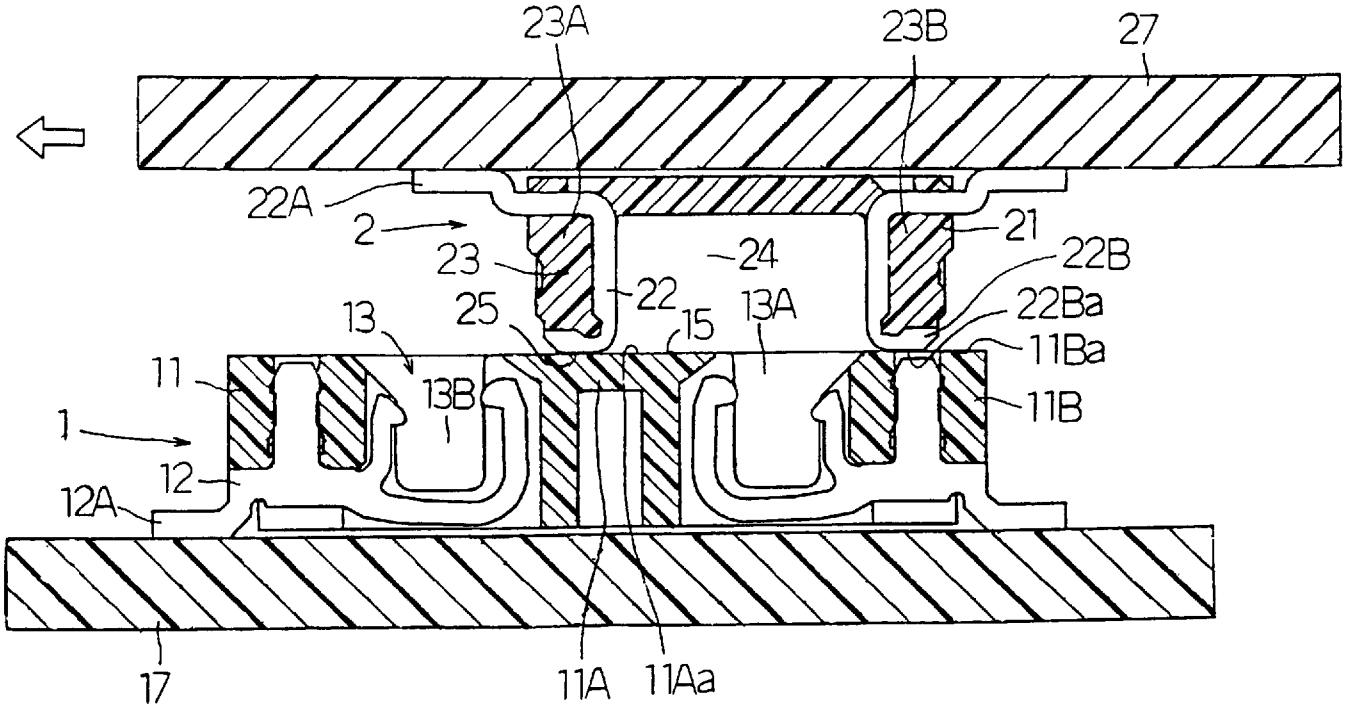
FIG. 1 is a cross-sectional view of one embodiment of an electric connector assembly constructed in accordance with the principles of the present invention before assembly.

Referring to the drawings, FIGS. 1–11 illustrate an embodiment of an electric connector assembly 1 constructed in accordance with the principles of the present invention. It can be seen that the connector assembly 1 comprises a pair of connector components 2, 3 for connecting one printed circuit board 4 to another printed circuit board 5. The plug connector component 2 is shown as fixed to the printed circuit board 4, while the receptacle connector component 3 is shown as fixed to the other printed circuit board 5.

Referring now to FIGS. 3 to 6 and 11, the plug connector 2 includes a housing 6 of an insulative material, such as plastic, and a plurality of conductive terminals 7 arranged at regular intervals along the length L of the connector component 2. The terminals 7 are arranged in two distinct sets, or arrays, and are fixed to the insulative housing 6. The plug housing 6 has a rectangular central portion, shown as a pedestal 8. The center pedestal 8 has a substantially flat or planar top surface 9 that permits the plug connector 2 to be assembled onto the circuit board 3 with a vacuum pick and place mechanism. The top surface 9 is preferably sufficiently broad to protect tops of the terminals 7 from impact during mating with the receptacle connector 3 which could adversely deform the terminal 7. The pedestal 8 is surrounded by a series of sidewalls 10*a*–10*d*. The side walls 10*a*–10*d* all have the same height above a bottom 11 of the housing 6 as each other and the pedestal 8. Top surfaces 12*a*–12*d* of side walls 10*a*–10*d*, respectively, are coplanar with each other and with the top surface 9 of the pedestal 8.

Edges 9*a*–9*d* of top surface 9 of the pedestal 8 and inner surfaces 12*e*–12*h* of side walls 10*a*–10*d* cooperatively define a mating channel 13 therebetween in which portions of the receptacle connector 3 fit. Edge 9*a* of the pedestal 8 and the inner surface 12*e* of side wall 10*a* define a segment 13*a* of the mating channel 13, edge 9*b* of the pedestal and inner surface 12*f* of side wall 10*b* define a segment 13*b* of mating channel 13, edge 9*c* and inner surface 12*g* of side wall 10*c* define a segment 13*c* of mating channel 13, and edge 9*d* and inner surface 12*h* of side wall 10*d* define a segment 13*d* of mating channel 13. Edges 9*a*, 9*c* of the pedestal are slightly chamfered to facilitate mating. A plurality of terminal-receiving slots 14 are formed at regular intervals lengthwise along opposing segments 13*a* and 13*c* of the mating channel 13 that extend to the bottom 11 of the housing 6. The terminals 7 are inserted into the terminal slots 14 from the bottom 11 of the housing 6.

Figure 3:
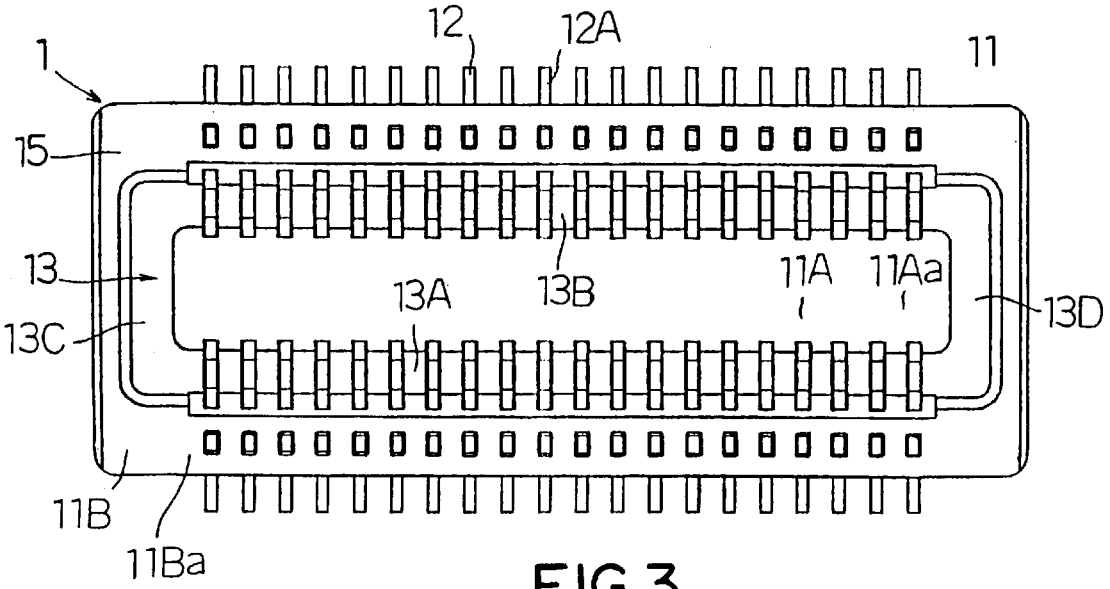
FIG. 3 is a plan view of the plug connector of the electric connector assembly of FIG. 1.
Figure 4:
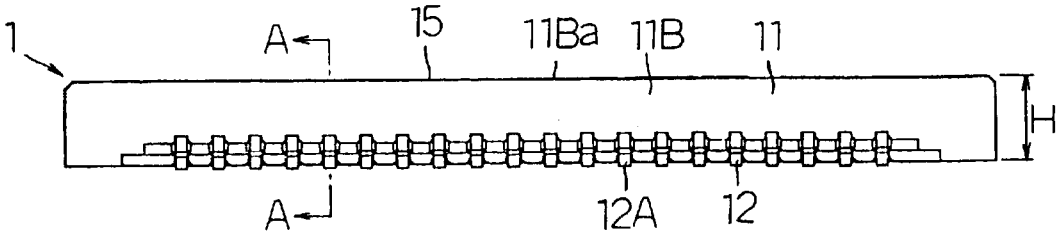
FIG. 4 is a side elevational view of the plug connector of FIG. 3 taken along lines 4—4 thereof.
Figure 5:
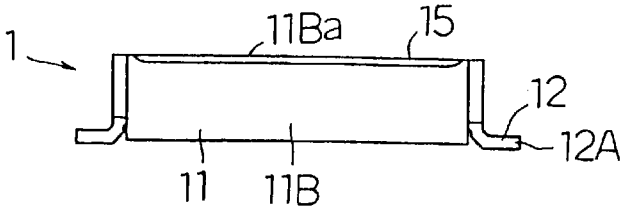
FIG. 5 is an end elevational view of the plug connector of FIG. 4 taken along lines 5—5 thereof.

As can be seen in FIG. 3, corners 18*a*–18*d* between adjacent walls 10*a*–10*d* are radiused, rather than the sharp, angled corners used in conventional construction. These radiused corners 18*a*–18*d* permit the sidewalls 10*a*–10*d* to be made thinner and reduce the likelihood of detrimental stress concentrations from occurring at the corners of the housing 6 under impact loading, which, for example, may occur when an electronic device containing the connector assembly 1 is dropped. Additionally, corners 22*a*–22*d* of the top surface 9 of pedestal 8 between adjacent edges 9*a*–9*d* are also radiused. Consequently, radiused inner and outer corners are defined between segments 13*a*–13*d* of the mating channel 13. The inner corners 18*a*–18*d* and the outer corners 22*a*–22*d* preferably have a radius of 0.2 mm.

To further facilitate mating with the receptacle connector 3, upper portions of inner surfaces 12*e*–12*h* of side walls 12*a*–12*d* are provided with chamfered lips 20*a*–20*d*, respectively. The chamfered lips also extend around the radiused corners 18*a*–18*d*.

The terminals 7 used in the plug connector 2 may be formed from metal blanks in a known manner, such as by stamping and forming. As shown best in FIG. 6, each terminal includes a horizontal base or body portion 24, a contact portion 26 having a free end with a general L-shape that extends from and is integrally connected to a front end of the base portion 24, a connector locking portion 30 rising from the base portion 24, a housing retention portion 32 rising from the base portion 24 and a solder tail 34 extending generally horizontally from the rear end of the base portion 24.

Figure 6:
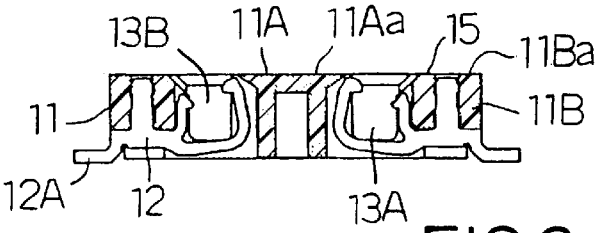
FIG. 6 is a cross-section of the plug connector taken along line A—A in FIG. 4.

The contact portion 26 of the terminal 7 has a contact head 36 projecting from the free end thereof, while the locking portion 30 of the terminal 7 has a locking head 38 projecting from the free end thereof. The contact head 36 and the locking head 38 oppose each other as shown in FIG. 6 and are spaced apart from each other to define an intervening space, or nest 42 therebetween. The contact portions 26 are disposed in contact cavities 27 in the pedestal 8. The locking portions 30 are disposed in locking cavities 31 in the inner surfaces 12*e* and 12*g* of side walls 10*a*, 10*c*, respectively. As best seen in FIG. 3, the housing 6 has a plurality of terminal-mounting holes 44 formed therein along the outer walls 10*a*, 10*c* thereof, each of the mounting holes 44 being preferably aligned in one-to-one order with each terminal slot 14 in order to accommodate the retention portions 32 of the terminals 7.

Each terminal 7 may be assembled in the housing 6 by press-fitting the retention portion 32 into the mounting holes 44 of the housing 6. The press-fit enables retention barbs 33 of the retention portions 32 to cut into the opposing inner walls of the hole 44, to positively retain the terminals 7 in the housing 6. In position, each terminal 7 is maintained stationary in the housing 6 with its contact portion 26 and locking portion 30 facing each other, and defining the nest 42 that receives a portion of the receptacle connector 3 and associated terminals 46 thereof. The solder tail portions 34 of the terminals 7 extend outwardly of the housing 6 for effective and reliable mounting to a mounting surface of the circuit board 4.

Referring now to FIGS. 7 to 11, it can be seen that the receptacle connector 3 includes an insulative housing 50 of plastic and a plurality of conductive terminals 46 longitudinally arranged in the housing 50 at regular intervals in two distinct sets. The rectangular housing 50 is designed to mate with the housing 6 of the plug connector 2, and as such, it includes a base plate 52 and surrounding side walls 54*a*–54*d*. The receptacle terminals 46 are fixed to the side walls 54*a* and 54*c* of the receptacle housing 50 in a convenient manner such as by insert molding them in the housing 50. Holes 51 in the base plate 52 are formed by a portion of a mold part which supports the terminal during molding. The side walls 54*a*–54*d* are provided with inner surfaces 55*a*–55*d*, outer surfaces 56*a*–56*d* and top surfaces 57*a*–57*d*, respectively. The side walls 54*a*–54*d* all have the same height above the base plate 52 and have generally coplanar top surfaces 57*a*–57*d*. Outer corners 58*a*–58*d* between adjacent outer surfaces 56*a*–56*d* are radiused to correspondingly fit within radiused corners 18*a*–18*d* of the plug housing 6, and inner corners 58*e*–58*h* between adjacent inner surfaces 55*a*–55*d* are radiused to correspondingly receive radiused corners 22*a*–22*d* of the top surface 9 of the pedestal 8 of the plug connector 2. The outer corners 58*a*–58*d* preferably have a radius of 0.25 mm and the inner corners 58*e*–58*h* preferably have a radius of 0.1 mm. Additionally, to further facilitate mating with the plug connector 2, upper portions of outer surfaces 56*a*–56*d* of sidewalls 54*a*–54*d* are provided with chamfered lips 56*e*–56*h*, respectively.

Figure 10:
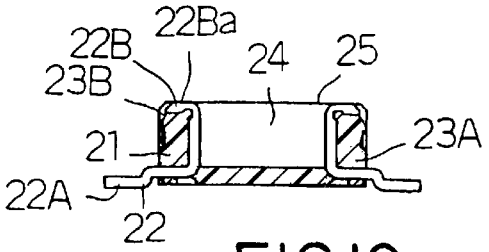
FIG. 10 is a cross-section of the receptacle connector taken along line B—B of FIG. 8.
Figure 11:
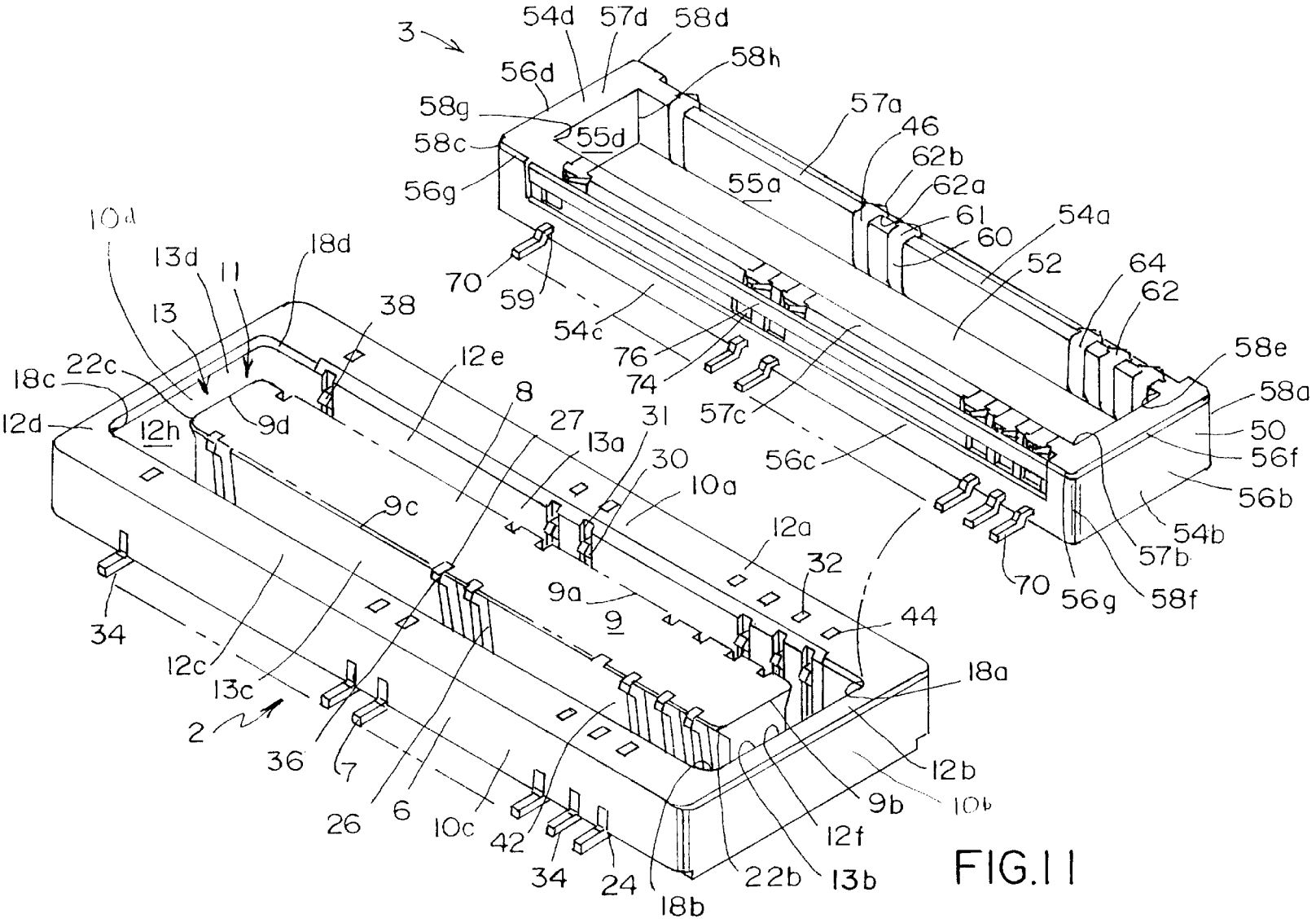
FIG. 11 is a perspective view of the plug connector and the receptacle connector of the present invention.

The receptacle terminals 46 are also preferably formed from metal blanks by stamping and forming. As best seen in FIG. 10, each terminal 46 comprises a horizontal base or body portion 59, a contact portion 60 vertically extending from the base portion 59 and a horizontal top portion 61 orthogonally extending from the contact portion 60. The terminals 46 are preferably arranged at the same spacing as are the terminals 7 of the plug connector 2, with each terminal 46 being insert molded into the respective sidewall 54*a*, 54*c* of the receptacle housing 50. In this orientation, exposed, inner surfaces of the contact portions 60 of terminals 46 are flush with the inner surfaces 55*a*, 55*c* of the side walls 54*a*, 54*c*, respectively, and exposed, top surfaces of the top portions 61 of terminals 46 are flush with top surfaces 57*a*, 57*c* of side walls 54*a*, 54*c*. The other surfaces of the contact portion 60 and the top portion 61 are embedded in side walls 54*a*, 54*c*of the receptacle housing 50.

Figure 7:
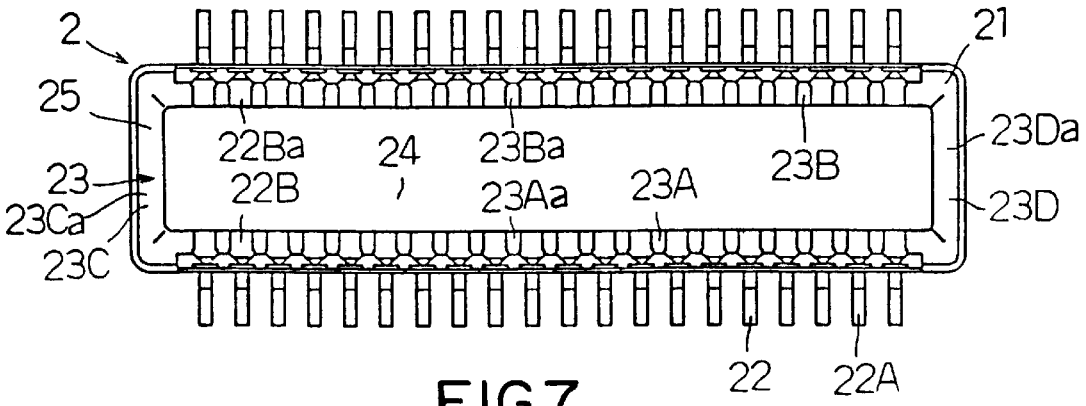
FIG. 7 is a plan view of the receptacle connector of the electric connector assembly of FIG. 1.

As best seen in FIG. 7, the top portion 61 includes a triangular retaining head 62 with outer edges 62*a* that extend outwardly of the edges of the top portion 61 for anchoring the top portion 60 in the side walls 54*a*, 54*c* and prevent the terminal 46 against moving inwardly. The retaining head 62 also has a chamfered tip 62*b* to facilitate engagement by the locking head 38 of the plug terminal 7 upon mating with the plug connector 2.

An inner corner of an intersection 64 between the top portion 61 and the contact portion 60 includes a radiused recess 66. The recess 66 is formed in the receptacle terminal 46 before the top portion 60 is bent with respect to the contact portion 60. Upon insert molding the terminal 46 in the housing 50, the plastic of the side wall 54*a*, 54*c* fills in the recess 66 to form a protrusion 68. The outermost edge of the recess 66 abuts against the outermost edge of the protrusion 68 to further prevent the terminal 46 from moving inwardly. The outer corner of the intersection 64 is also radiused to facilitate engagement by the contact head 36 of the plug terminal 7 upon mating with the plug connector 2.

A solder tail portion 70 extends horizontally from the rear of the base portion 59. A bottom surface of the solder tail portion 70 lies below the receptacle base 52 of the housing 50 for mounting on a surface of the circuit board 5.

Figure 8:
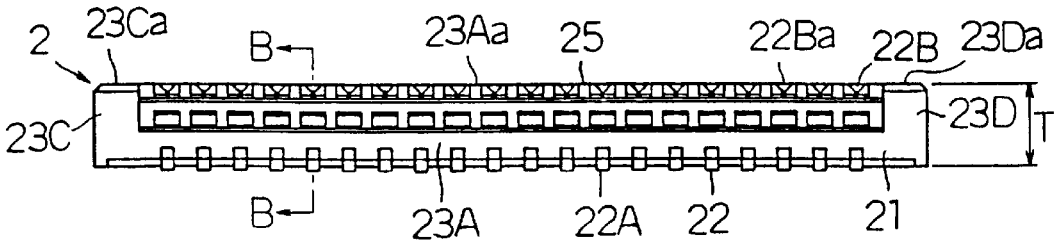
FIG. 8 is a side elevational view of the receptacle connector of FIG. 7 taken along lines 8—8 thereof.
Figure 9:
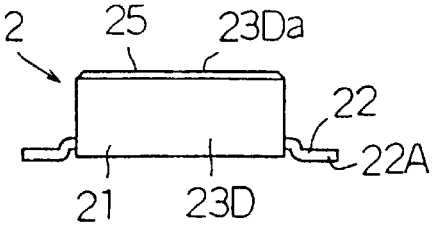
FIG. 9 is an end elevational view of the receptacle connector of FIG. 8 taken along lines 9—9 thereof.

As best seen in FIG. 8, each longitudinal sidewall 54*a*, 54*c* of the receptacle housing 50 has a plurality of recesses 74 formed on outer surfaces 56*a*, 56*c* which are intended to engage or "catch" the locking heads 38 of the locking portions 30 of the plug connector 2 when the plug and receptacle connectors 2, 3 are mated together. As seen in FIGS. 8 & 10, each such recess 74 has an abutment 76, or shoulder, formed at the top thereof. This shoulder 76 provides a surface against which the locking heads 38 catch and cooperatively retain the connectors 2, 3 together in an interlocked condition.

As shown in FIG. 1, during mating, the top surfaces 57*a*–57*d* of side walls 54*a*–54*d* containing the exposed surfaces of the top portions 61 of the terminals 46 of the receptacle connector 3 slide along the coplanar top surfaces 12*a*–12*d* of side walls 10*a*–10*d* and coplanar top surface 9 of pedestal 8 of the plug connector 2. The chamfered lips 56*e*–56*h* on receptacle connector 3 cooperate with chamfered lips 20*a*–20*d*, radiused corners 18*a*–18*d* cooperate with outer corners 58*a*–58*d*, and radiused corners 22*a*–22*d* cooperate with radiused corners 58*e*–58*h* of the receptacle connector 3 to guide side walls 54*a*–54*d* of the receptacle connector 3 into registration with corresponding channel segments 13*a*–13*d* of the plug connector 2, respectively.

These features are beneficial for blind mating the plug and receptacle connector 2, 3 together. The top planar surface 9 on the pedestal 8 of the connector 2 prevents the receptacle connector 3 from mating with the plug connector 2 in an oblique direction. Oblique mating could result in improperly impacting the terminals 7 and deforming or damaging the terminals 7. The lateral channel segments 13*b*, 13*d* of the plug connector 2 and lateral side walls 54*b*, 54*d* of the receptacle connector 3 prevent one of the longitudinal side walls 54*a* or 54*c* of the receptacle connector 3 from falling into the wrong longitudinal channel segment 13*a* or 13*c* of the plug connector 2 during mating. The closed-loop configuration of the mating channel 13 and the side walls 54*a*–54*d* of the connector assembly 1 assure parallel displacement between the plug connector 2 and the receptacle connector 3.

Upon registration, the plug connector 2 and the receptacle connector 3 are permitted to move closer to each other as the side wall 54*a* of receptacle housing 6 engages the segment 13*c* of mating channel 13, the side wall 54*b* engages the segment 13*b*, the side wall 54*c* engages the segment 13*a*, and the side wall 54*d* engages the segment 13*d*. The side walls 54*a*–54*d* of the receptacle connector 3 descend directly downwardly in the mating channel segments 13*a*14 13*d*, respectively, of the plug connector 2.

To complete mating, the plug connector 2 is pressed together with the receptacle connector 3. During mating, the contact heads 36 of plug terminals 7 ride along the radiused outer corners of the intersection 64 of receptacle terminals 46 to facilitate mating. The contact portions 26 of the plug terminal 7 are preloaded slightly by their shape which extends the contact heads 36 toward the interior of the plug connector 2. This preloading causes the contact portions 26, and particularly the contact heads 36 thereof, to frictionally engage the contact portions 60 of the terminal 46.

Figure 2:
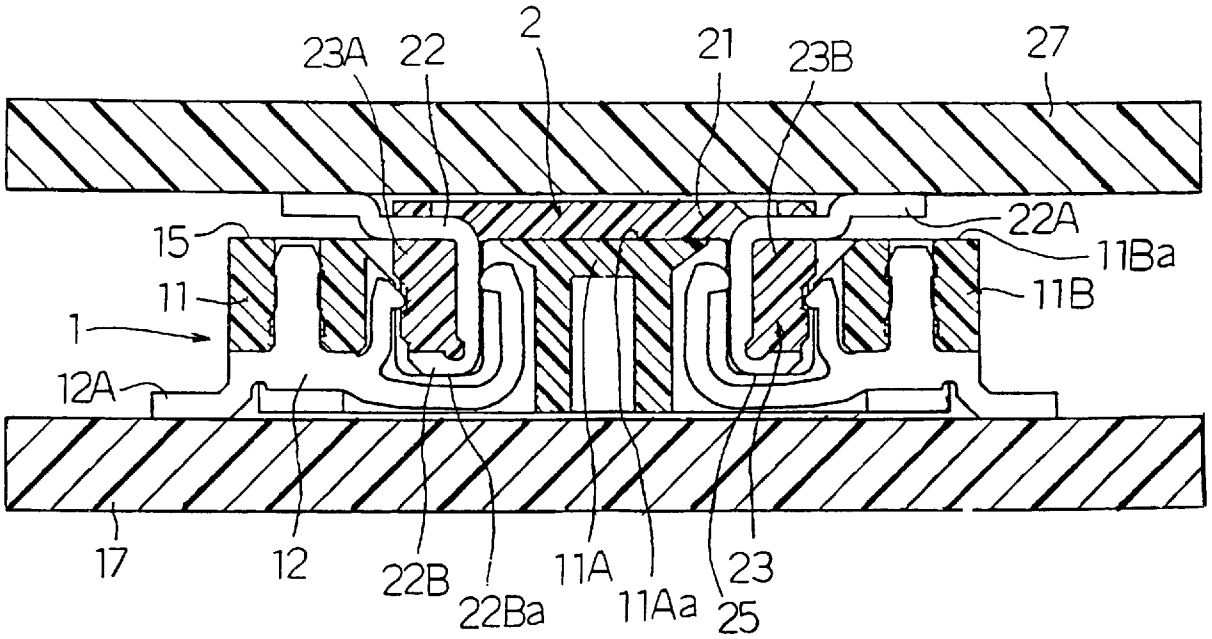
FIG. 2 is a cross-sectional view of the assembly of FIG. 1 after assembly.

The locking heads 38 of the locking portions 30 ride upon the outer surfaces 56*a*, 56*c* of the sidewalls 54*a*, 54*c* of the receptacle connector 3 until they are caught in the recesses 74 to lie against the shoulders 76 defined thereon as shown in FIG. 2. The interengagement of the terminal locking portions 30 and the catches 74 reliably retains the connectors 2, 3 together.

It can be seen from FIGS. 2 and 6 that the contact heads 38 and the locking heads 36 of the terminals 7 are spaced apart from each other at different elevations relative to the bottom 11 of the housing 6 of the plug connector 2. This staggers their order of engagement with the receptacle connector 3. First, each contact portion 26 of the terminals 7 of the plug connector 2, particularly the contact head 36 thereof, engages the corresponding, radiused outer corner of the intersection 64 of terminals 46 of the receptacle connector 3. Second, each locking portion 30 of the terminals 7 of the plug connector 2, particularly the locking head 38 thereof, engages the corresponding chamfered tips 62*b* of receptacle terminals 46 of the receptacle connector 3. Thus, a "two-stage" insertion action is effected.

The two-stage insertion action dilutes the insertion force. Because the contact head 36 engages the outer corner of the intersection 64 at a different time than the locking head 38 engages the chamfered tip 62*b*, the initial frictional engagement forces do not cumulatively operate to resist insertion, thereby diluting the insertion force. To further dilute the insertion force, the radiused outer corner of intersection 64 and the chamfered tip 62*b* of the receptacle terminal 46 facilitate movement of the heads 36 and 38 toward their final mating position against the contact portion 60 of the terminal 46 and in the receptacle recess 74, respectively.

FIG. 2 illustrates the plug and receptacle connectors 2 and 3 mated together. The solder tail portions 34 of the terminals 7 of the plug connector 2 are soldered to the printed circuit board 4, whereas the solder tail portions 70 of the terminals 46 of the receptacle connector 3 are soldered to the printed circuit board 5. Mating the plug connector 2 with the receptacle connector 3 establishes an electrical connection between the printed circuit boards 4 and 5.

The electric connector assembly 1 according to the present invention assures reliable coupling of the connectors 2, 3 without requiring any extra operation. The metal terminals 7 of the plug connector 2 exert a frictional retention force on the opposing receptacle connector 3. The combination of the direct engagement by the locking portions 60 of terminals 46 of the plug connector 2 with recesses 74, coupled with the frictional engagement by the contact portions 26 of the plug connector 2 with the contact portions 60 of the terminals 46 of the receptacle connector 3 increases the withdrawal force necessary to separate the connector components 2, 3 apart. Thus, with this "two-stage" retention capability, the likelihood of accidental unmating of the connector components 2, 3 of the connector assembly 1 and their corresponding circuit boards 4, 5 is significantly decreased.

While the preferred embodiments of the invention have been shown and described, it will be apparent to those skilled in the art that changes and modifications may be made therein without departing from the spirit of the invention, the scope of which is defined by the appended claims.

We claim:

1. An electrical connector for engaging with a corresponding mating electrical connector in order to effect a connection between two circuit boards, said connector comprising:

a housing formed from an electrically insulative material having a first side wall adjoining a second side wall adjoining a third side wall, adjoining a fourth side wall;

a raised pedestal located between first and third side walls, a top surface of said pedestal of said housing being coplanar with top surfaces above said side walls;

a row of electrically conductive terminals disposed in spaced-apart order in said housing along said first inner edge and below said top surface of said pedestal, said terminals each including a retention portion for retaining said terminal in place in said spaced-apart order in said housing and a contact portion for contacting a mating terminal disposed in corresponding portions of the mating connector; and a first inner surface of said side wall, a second inner surface of said second side wall adjoining said first inner surface at a first inner corner, a third inner surface of said third side wall adjoining said second inner surface at a second inner corner and a fourth inner surface of said fourth side wall adjoining said third inner surface of said third side wall at a third inner corner, said fourth inner surface adjoining said first inner surface at a fourth inner corner; and outer edges of said top surface of said pedestal and said first inner surface, said first inner corner, said second inner surface, said second inner corner, said third inner surface, said third inner corner, said fourth inner surface and said fourth inner corner of said side walls defining a mating channel configured as a closed loop for receiving correspondingly configured portions of the mating connector.

2. The electrical connector of claim 1 wherein at least one of said inner corners between said adjacent side walls is radiused.

3. The electrical connector of claim 2 including a first outer edge of said top surface opposed to said first inner surface of said first side wall, a first outer, radiused corner of said top surface opposed to said first inner corner, a second outer edge of said top surface opposed to said second inner surface of said second side wall, a second outer, radiused corner of said top surface opposed to said second inner corner, a third outer edge of said top surface opposed to said third inner surface of said third side wall, a third outer, radiused corner of said top surface opposed to said third inner corner, a fourth outer edge of said top surface opposed to said fourth inner surface of said fourth side wall and a fourth outer, radiused corner of said top surface opposed to said fourth inner corner further defining said mating channel.

4. The electrical connector of claim 3 wherein the mating channel comprises a first segment adjacent said first side wall, a second segment contiguous with said first segment and adjacent to said second side wall, a third segment contiguous with said second segment and adjacent to said third side wall, and a fourth segment contiguous with said third segment and adjacent to said fourth side wall.

5. The electrical connector of claim 1 wherein said terminal includes an engagement portion opposed to said contact portion for engaging a portion of said mating connector received into said mating channel for retaining said portion of said mating connector in place within said mating channel.

6. The electrical connector of claim 5 wherein said contact portion and said engagement portion of each said terminal are disposed in said connector housing on opposite sides of said mating channel for cooperatively engaging the portion of the mating connector inserted into said mating channel.

7. The connector of claim 5 wherein said contact portion of said terminals includes a contact head that protrudes toward said mating channel and said engagement portion includes a locking head that protrudes toward said mating channel in opposition to the contact head of the terminal.

8. The connector of claim 7 wherein said contact head and said locking head are disposed at different heights from the bottom of the housing.

9. The connector of claim 8 wherein said retention portion is spaced apart from said contact portion.

10. The connector of claim 1 wherein upper portions of said inner surfaces of said side walls are downwardly inclined.

11. An electrical connector assembly for connecting two circuit boards together, the assembly including:

first and second interengaging connectors, each of the first and second connectors including respective first and second housings and respective first and second sets of conductive terminals, each of the conductive terminals having a contact portion disposed within a portion of one of said first and second connector housings, a solder tail portion extending out of said housing and a body portion interconnecting said contact and solder tail portions;

said first housing formed from an electrically insulative material having a first side wall adjoining a second side wall, said second side wall adjoining a third side wall, said third side wall adjoining a fourth side wall and said fourth side wall adjoining said first side wall, a raised pedestal located between first and third side walls, a top surface of said pedestal and top surfaces above said side walls being coplanar, a first inner surface of said first side wall, a second inner surface of said second side wall adjoining said first inner surface at a first inner corner, a third inner surface of said third side wall adjoining said second inner surface at a second inner corner and a fourth inner surface of said fourth side wall adjoining said third inner surface at a third inner corner, said fourth inner surface adjoining said first inner surface at a fourth inner corner, inner surfaces of said side walls and outer edges of said top surface of said pedestal defining a mating channel having a configuration of a closed loop, contact portions of said first set of terminals being disposed along said mating channel;

said second housing including a first side wall adjoining a second side wall at a first outer corner, said second side wall adjoining a third side wall at a second outer corner, said third side wall adjoining a fourth side wall at a third outer corner, and said fourth side wall adjoining said first side wall at a fourth outer corner, said side walls being configured to define a closed loop corresponding to the configuration of the mating channel of said first housing, said side walls of said second housing engaging within the mating channel of the first housing when the side walls of the second housing are registered with the mating channel of the first housing; and contact portions of said second set of terminals being disposed along said first and third side walls for engagement with respective ones of said first set of terminals when said side walls of said second housing are engaged within said mating channel of said first housing.

12. The connector assembly of claim 11 wherein at least one of said inner corners between adjoining side walls of said first housing is radiused.

13. The connector assembly of claim 12 wherein at least one of said outer corners between adjoining side walls of said second housing is radiused.

14. The connector assembly of claim 11 wherein upper portions of said inner surfaces of side walls of said first housing are downwardly inclined.

15. The connector assembly of claim 11 wherein upper portions of said side walls of said second housing are downwardly inclined.

16. The connector assembly of claim 11 wherein outer edges of said top surface of said pedestal are downwardly inclined.

* * * * *